United States Patent [19]

Ramsdale

[11] 3,981,092

[45] Sept. 21, 1976

[54] SLIDE FRAME

[75] Inventor: Roy Ramsdale, Willowdale, Canada

[73] Assignee: Alex L. Clark Limited, Toronto, Canada

[22] Filed: May 21, 1974

[21] Appl. No.: 471,849

[52] U.S. Cl. ..... 40/158 R

[51] Int. Cl.[2] ..... G09F 1/10

[58] Field of Search ..... 40/124, 125 A, 158 B, 40/158 R, 152

[56] References Cited

UNITED STATES PATENTS

| | | | |
|---|---|---|---|
| 2,164,655 | 7/1939 | Kleerup | 40/158 B X |
| 2,250,583 | 7/1941 | Krauter | 40/125 A X |
| 2,977,017 | 3/1961 | Herzig | 40/158 R |
| 3,069,795 | 12/1962 | Lieberman | 40/152 |

FOREIGN PATENTS OR APPLICATIONS

| | | | |
|---|---|---|---|
| 1,102,106 | 5/1955 | France | 40/152 |
| 805,490 | 9/1951 | Germany | 40/158 R |

*Primary Examiner*—Louis G. Mancene
*Assistant Examiner*—Wenceslao J. Contreras

[57] ABSTRACT

A mount for holding a photographic film transparency. The transparency is mounted on a pair of rail sections adhering to its edge portions. The rails are receivable in opposed slots in a frame whereby the transparency bridges a picture aperture in the frame. Stop means on the sides of the frame transverse to the slots prevents the transparency from sliding along the slots. Apparatus for adhering a strip of the transparencies to severable lengths of the rails comprises a channel to receive the strip and having grooves to receive the rails, and a roller movable along the channel with raised rings to run along the rails in the grooves.

2 Claims, 4 Drawing Figures

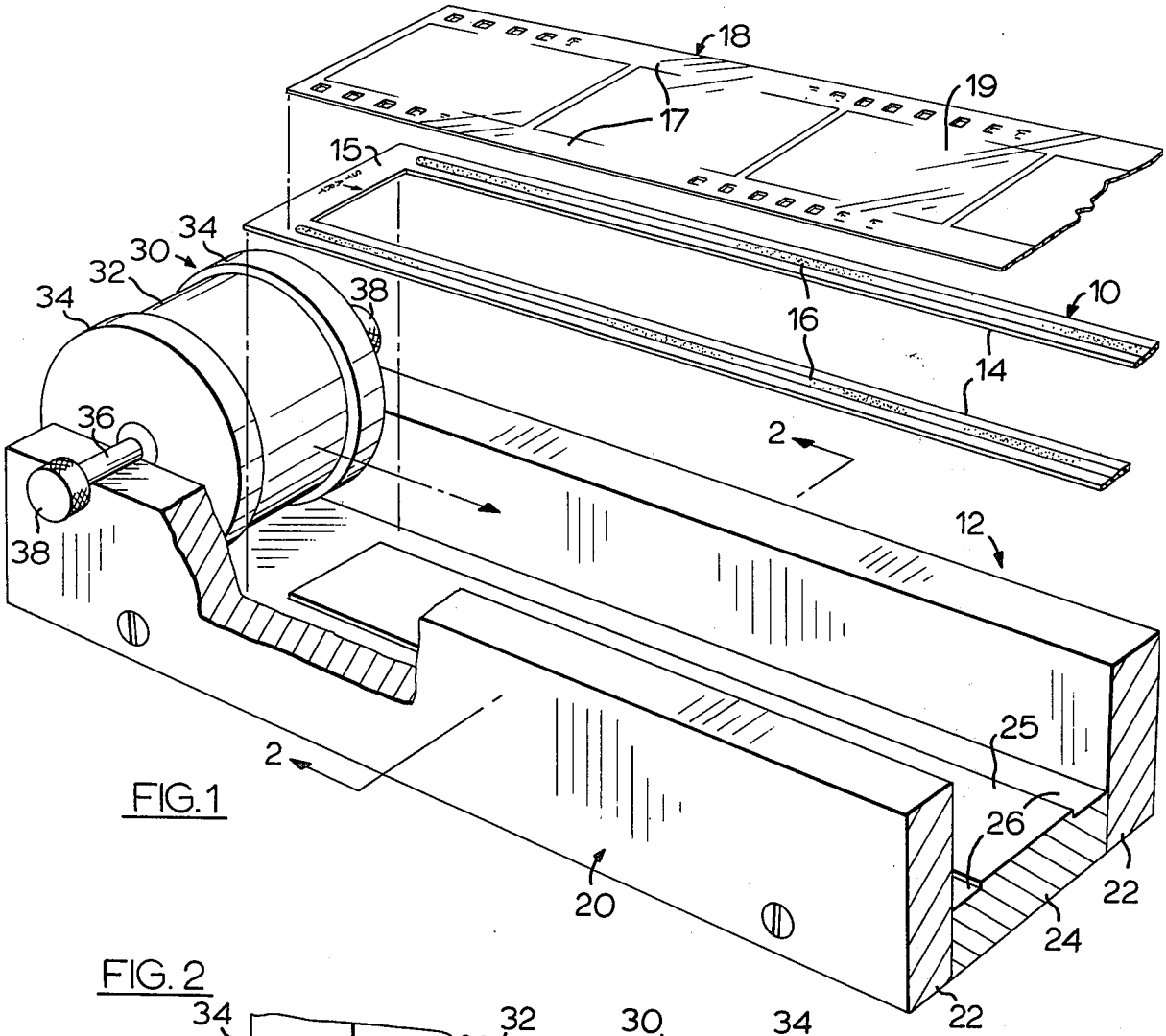
FIG. 1
FIG. 2
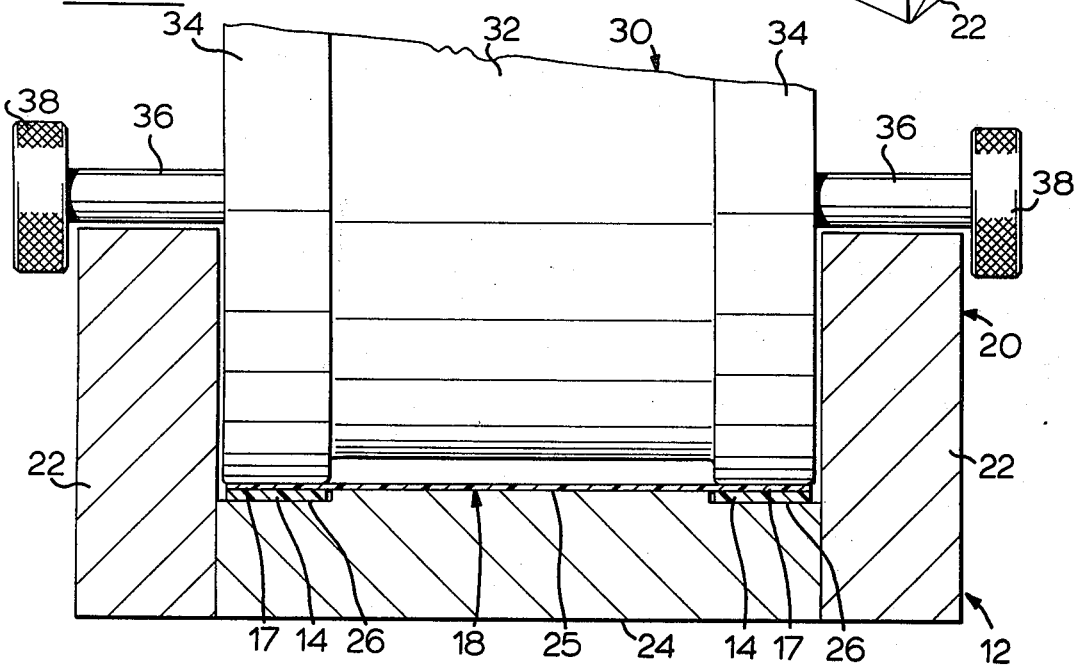

SLIDE FRAME

This invention relates to a mount for holding a photographic film transparency.

Film transparency mounts presently in use are made in two parts which are brought into registration to hold a single transparency. The parts of the mount must be shaped with precision and for this reason each part must be manufactured by stamping, which makes the mount expensive to produce. Also, each picture is cut separately from a strip of film and is mounted by hand, either before or after assembly of the mount, to centre the picture in the mount aperture. This type of mounting procedure is costly in labor.

It is an object of the present invention to provide a sectionable frame element which enables a strip of exposed photographic film transparencies to be mounted on lengths of the frame element in a single step.

A further object of the invention is to provide a mount including a single transparency severed from a strip of transparencies mounted on lengths of a sectionable frame element.

Still another object of the invention is to provide an apparatus for applying a strip of film transparencies to a sectionable frame element.

In its broadest aspect the invention consists of a frame element comprising a sectionable rail carrying a band of adhesive to adhere lengths of the rail to opposed edge portions of a strip of transparencies.

In another aspect the invention consists of a frame comprising a mat having a picture aperture, a pair of shoulders on one face of the mat and on opposite sides of the aperture, a lip on each shoulder overhanging the mat to form opposed slots, and stop means carried by said one face of the mat on opposed sides of the aperture transverse to said shoulders, lengths of the frame element being receivable, when adhered to a transparency, in the frame to form a mount.

In another aspect the invention consists of a slide mount comprising a slide frame as set forth above, and a single transparency carrying a pair of rail lengths received in the slots whereby the transparency bridges the aperture and laterally abuts the stop means.

In still another aspect the invention consists of an apparatus for mounting a film transparency strip on lengths of a frame element rail of the type set forth above, the apparatus channel with a pair of parallel grooves in the inner surface of the bottom of the channel to receive the rails flush with said surface, and a roller with raised parallel circumscribing rings spaced apart the width between the grooves to press the edge portions of the film strip onto the adhesive of the frame element when the roller is moved along the channel.

Example embodiments of the invention are shown in the accompanying drawings, in which:

FIG. 1 is an exploded perspective view of a frame element with a strip of film transparencies applied to lengths of the frame element, and a device for pressing the film strip onto the frame element;

FIG. 2 is a view in cross-section taken along line 2—2 of FIG. 1;

Figure 3:
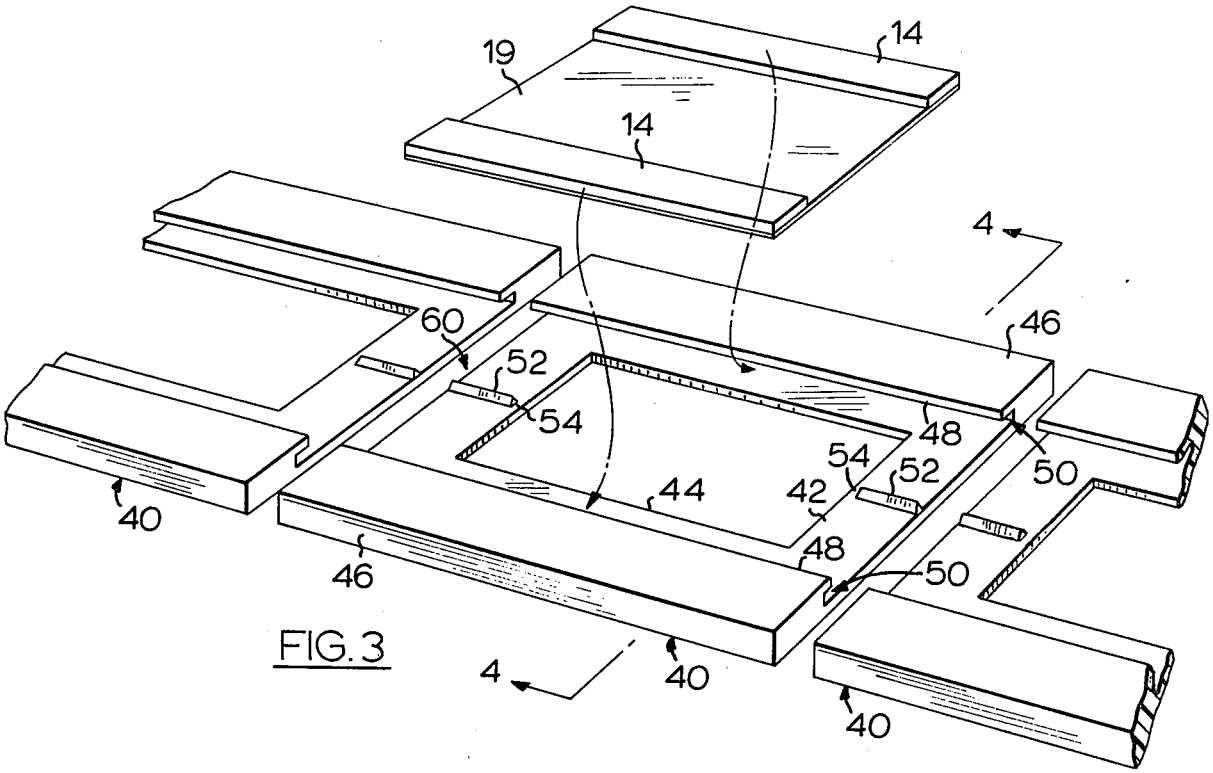
FIG. 3 is an exploded perspective view of a slide mount.

The example embodiments shown in FIG. 1 of the drawings consist of a frame element 10 and an applicator 12.

Frame element 10 consists of a pair of parallel rails 14 spaced apart by an integral connector 15 at each end of the rails to form a track. Each rail 14 carries an adhesive band 16 of pressure sensitive adhesive on one face of frame element 10. The distance between rails 14 is the same as that between edge portions 17 of a strip 18 of film transparencies 19.

Applicator 12 consists of a channel 20 having a pair of side walls 22 and a bottom 24. A pair of parallel, shallow, flat grooves 26 are located on inner surface 25 of bottom 24, one groove being contiguous with each side wall 22 of channel 20. Grooves 26 are contoured to receive rails 14 of frame element 10 with bands 18 being flush with inner surface 25 of channel 20. A roller 30, movable along channel 20, comprises a drum 32 having a pair of parallel, circumscribing rings 34 which are spaced apart the width between grooves 26. Each ring 34 is approximately the width of each groove 26. Drum 32 is journalled on an axle 36 which carries knurled end caps 38.

In operation, a frame element 10 is placed in channel 20 with rails 14 lying in grooves 26 and adhesive bands 18 facing upwardly. A strip 18 of film transparencies 19, previously exposed and processed, is laid in channel 20 on inner surface 25 of bottom 24 with each edge portion 17 overlying a rail 14 of frame element 10. Roller 30 is then moved along channel 20, using hand grips 38, and rings 34 press against edge portions 17 of strip 18 to adhere the strip to frame element 10. Of course connector 15 may be omitted and individual rails 14 merely laid in grooves 26.

Film strip 18, with rails 14 adhered to edge portions 17 of the strip, is then severed, together with rails 14, into single transparencies 19.

Figure 4:
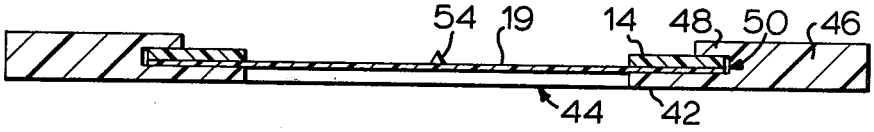
FIG. 4 is a cross-sectional view taken along line 4—4 of FIG. 3.

FIGS. 3 and 4 of the drawings show a slide mount 40 incorporating a length of frame element 10 carrying a single slide transparency 19. Mount 40 consists of a rectangular mat 42 of substantially rigid material with a cut-out rectangular window 44. Two opposed edge portions of mat 42 carry parallel shoulders 46 which have inturning lips 48 overhanging mat 42 to form a pair of opposed slots 50 spaced back from the edges of window 44. The distance between lips 48 is less than the width of film strip 18 while the distance between shoulders 46 is at least as great as the width of film strip 18. End stops in the form of a pair of ribs 52 are located on mat 42 midway between slots 50 and these ribs terminate short of the edges of window 44 to define a ledge 54 formed by the mat adjacent the window.

In use, slide mount 40 receives a single transparency 19 severed from film strip 18 which has been fixed onto frame element 10. As seen in FIG. 3, transparency 19 is arched about its longitudinal centre line between strips 14 and the strips are inserted into slots 50 in mount 40, allowing the transparency to lie flat against mat 42 between shoulders 46 and between ribs 54.

The distance between shoulders 46 should be at least as great as the width of film strip 18 and the height of slot 50 (the distance between flange 48 and mat 42) should be at least equal to the combined thicknesses of strips 14 and transparency 19. The distance between the opposing ends of ribs 52 (across window 42) should be at least as great as the length between the cut edges of transparency 19.

The structure of frame element 10 and slide mount 40 enable them to be manufactured of extruded plastic material such as polyvinylchloride. Rails 14 of frame element 10 may be extruded and cut into desired lengths after adhesive bands 16 have been applied to the rails. Slide mount 40 may be extruded and subsequently stamped to produce windows 44, ledges 54, and to sever the extended material into individual mounts. This eliminates the need for an injection mould which is much more expensive to produce and to operate for the manufacture of a large number of individual slide mounts.

It will be appreciated that the present invention enables a film strip 18 to be quickly and accurately positioned on frame element 10, run through a cutter, and each transparency 19 snapped into slide mount 40, thus reducing the amount of hand labor normally required to set the picture in its mount.

Also, the mount of the present invention is a one-sided mount, as opposed to mounts now on the market which have two sides which are brought together to hold the transparency, and this feature makes the present mount less costly to produce in addition to the other advantages set forth above.

I claim:

1. A frame for use in mounting a photographic film transparency, comprising a mat having a picture aperture, means on one face of the mat forming a pair of opposed slots one in each of two first opposed sides of the aperture, the slots being open at each end thereof, and stop means carried by said one face of the mat on the second opposed sides of the aperture transverse to the slots, said stop means comprising a rib located on each of said second opposed sides of the aperture, each of the ribs lying parallel to the slots centrally therebetween and terminating adjacent the aperture to define a ledge.

2. A mount holding a photographic film transparency, comprising a frame having a mat with a picture aperture, means on one face of the mat to form a pair of opposed slots one on each of two sides of the aperture, the slots being open at each end thereof, stop means carried by said one face of the mat one on each of the opposed sides of the aperture transverse to the slots, each of said stop means comprising a rib lying parallel to the slots centrally therebetween and terminating adjacent the aperture to define a ledge, a frame element comprising a pair of parallel rails spaced apart and each having a face carrying a band of pressure sensitive adhesive, a pair of opposed edge portions of said transparency being adhered to the rails, the rails lying in the slots and the transparency bridging the aperture between the slots and between the stop means.

* * * * *